United States Patent [19]

Husson

[11] 4,161,236

[45] Jul. 17, 1979

[54] ELEVATOR SYSTEM

[75] Inventor: Alan L. Husson, Hackettstown, N.J.

[73] Assignee: Westinghouse Electric Corp., Pittsburgh, Pa.

[21] Appl. No.: 911,575

[22] Filed: Jun. 1, 1978

[51] Int. Cl.[2] ..... B66B 5/04

[52] U.S. Cl. ..... 187/29 R

[58] Field of Search ..... 187/29

[56] References Cited

U.S. PATENT DOCUMENTS

| | | | |
|---|---|---|---|
| 3,779,346 | 12/1973 | Winkler | 187/29 |
| 4,067,416 | 1/1978 | Lowry | 187/29 |

*Primary Examiner*—Robert S. Macon
*Assistant Examiner*—W. E. Duncanson, Jr.
*Attorney, Agent, or Firm*—D. R. Lackey

[57] ABSTRACT

An elevator system including an elevator car mounted for guided movement in the hoistway of a building having a plurality of floors. The speed of the elevator car versus its position is monitored in terminal zones adjacent to the terminal floors, as the elevator car approaches each terminal floor. An overspeed signal is generated when an overspeed condition is detected. If the elevator car is traveling towards a terminal floor in a terminal zone but is not set to decelerate and stop at the terminal floor, the conditions for issuing the overspeed signal are modified such that the issuance of the signal is advanced in time, compared with the time at which it would be provided without such modification, with the magnitude of the advancement being inversely proportional to the speed of the elevator car.

5 Claims, 3 Drawing Figures

ELEVATOR SYSTEM

BACKGROUND OF THE INVENTION

1. Field of the Invention

The invention relates in general to elevator systems, and more specifically, to improved terminal slowdown apparatus for elevator systems.

2. Description of the Prior Art

It is necessary in elevator systems to provide a redundant, independent means for detecting an overspeed condition of an elevator car as it approaches a terminal floor. The speed monitoring and limiting means may monitor the floor selector. If the floor selector is not operating in a manner which will produce a normal slowdown, an auxiliary speed pattern is produced for controlling terminal slowdown. The speed monitoring and limiting means may monitor the speed pattern generator as the elevator car approaches a terminal. A terminal slowdown pattern is provided in place of the normal deceleration pattern when a malfunction is detected, to decelerate the car into the terminal floor.

Monitoring the floor selector, or speed pattern generator, however, only picks up a malfunction in the specific device monitored, and an overspeed condition due to malfunction of some other component would not be detected. Thus, a speed monitoring system adjacent to a terminal floor which monitors car speed as a function of car position is highly desirable.

Application Ser. No. 628,448 filed Nov. 3, 1975, which application is assigned to the same assignee as the present application now U.S. Pat. No. 4,085,823, discloses a discrete car speed monitoring system. This discrete monitoring system monitors car speed as a function of car position at a plurality of discrete speed checkpoints in the hoistway. The car speed is compared with two reference speeds at most car position checkpoints. If the car speed exceeds the lower but not the upper reference speed, the system attempts to decelerate the car by employing an auxiliary terminal slowdown velocity pattern. If the car speed exceeds the upper reference speed at any checkpoint, the car is forced to make an emergency stop.

Application Ser. No. 813,560, filed July 7, 1977, which application is assigned to the same assignee as the present application, now U.S. Pat. No. 4,128,141, is directed to an improvement in elevator car speed monitoring systems which monitor car speed as a function of discrete car positions adjacent to a terminal floor. In this application, the velocity signal provided as the elevator car passes a checkpoint is modified by a signal responsive to car acceleration. If the car is decelerating, the acceleration signal reduces the absolute magnitude of the velocity signal. If the car is accelerating, it increases it. Thus, the modified velocity signal includes an anticipation factor which takes into account the rate at which the car's speed is changing.

U.S. Pat. No. 3,779,346, which is assigned to the same assignee as the present application, discloses a terminal slowdown monitoring system which continuously monitors the car speed as a function of car position, as the car approaches each terminal floor. In this arrangement, closely spaced markers mounted in the hoistway adjacent to each terminal cooperate with a sensor disposed on the elevator car to provide a continuous speed error signal which is used in s reference circuit to detect overspeed. U.S. Pat. No. 4,067,416, which is assigned to the same assignee as the present application, discloses monitoring means which may be used to insure that this independent terminal slowdown apparatus is operative at all times.

The terminal slowdown monitoring systems of the continuous type which detect car speed versus position relative to a terminal floor, such as disclosed in the hereinbefore mentioned U.S. Pat. No. 3,779,346, provide very accurate and reliable monitoring of the terminal slowdown function. However, systems of this type have a built-in limitation which may result in exceeding desirable jerk limitations under certain operating conditions. The maximum allowable speed at any given distance from a terminal floor is determined by the distance to go and the preselected terminal slowdown deceleration rate. Thus, the maximum allowable speed at a predetermined distance from the terminal floor depends only on the distance and does not consider the present velocity and acceleration rate of the elevator car. For example, at 10 feet from the terminal floor, the maximum allowable velocity would be 9.5 ft/sec for an elevator that is decelerating, or for an elevator that is accelerating. While the maximum allowable speed may be acceptable for the decelerating elevator car, the accelerating elevator car has a jerk limitation and will travel some additional distance while the acceleration is changing to the full deceleration value. This, in effect, allows an accelerating car to run at speeds higher than desired as it approaches a terminal floor. An accelerating car moving towards a terminal floor in the terminal slowdown zone, may occur, for example, on a short run, such as a one-floor run into the terminal floor. The present invention is directed to new and improved terminal slowdown control of the continuous speed versus car position type, which enables an elevator car accelerating towards a terminal floor in a terminal slowdown zone to be placed on the desired slowdown speed pattern or curve as easily and smoothly as a decelerating car, without the risk of nuisance trips which are usually associated with efforts which attempt to shave the margin between maximum allowable normal slowdown speeds and speeds which will place the elevator car on independent terminal slowdown control.

SUMMARY OF THE INVENTION

Briefly, the present invention is a new and improved elevator system which includes continuous independent terminal slowdown speed monitoring as a function of car position in a terminal zone as the car approaches a terminal floor. If the elevator car is in the terminal zone, but it is not set to decelerate and stop at the terminal floor, this condition is recognized and the normal independent terminal slowdown function is modified. The conditions which normally determine the car speed at which an overspeed signal is generated to trigger the substitution of an auxiliary slowdown speed pattern for the normal slowdown speed pattern, are modified to produce the overspeed signal sooner that it would normally be provided, with the magnitude of the advancement in time being inversely proportional to the speed of the elevator car. If the elevator car is accelerating, the earlier trip of the terminal slowdown detection system allows extra time for a smooth transition between acceleration and deceleration exceeding the desired maximum speed. The amount that the maximum allowable speed reference is lowered depends upon the speed of the elevator car at that instant. When an elevator car has to make a change between acceleration and deceleration and stop at a terminal floor from a lower speed, the required transition distance is a larger fraction of the total slowdown distance than when the elevator car makes such a slowdown from a higher speed. Therefore, the maximum allowable speed reference is lowered by a larger amount at lower car speeds, and is lowered by a smaller amount at higher car speeds.

BRIEF DESCRIPTION OF THE DRAWINGS

The invention may be better understood and further advantages and uses thereof more readily apparent, when considered in view of the following detailed description of exemplary embodiments, taken with the accompanying drawings in which.

DESCRIPTION OF PREFERRED EMBODIMENTS

The present invention relates to elevator systems which continuously monitor elevator car speed as a function of car location adjacent to each travel limit or terminal floor. Since the elevator system of the hereinbefore mentioned U.S. Pat. No. 3,779,346 includes a detailed showing of a complete and operative elevator system of this type, the subject matter of this patent is hereby incorporated into the present application by reference. Only those parts of the incorporated patent necessary to understand the present invention are repeated herein, and FIG. 18 of this patent will be modified to illustrate the teachings of the instant invention. It is to be understood, however, that the invention is equally applicable to other types of elevator systems which continuously monitor car speed as a function of car location adjacent to a terminal floor.

Figure 1:
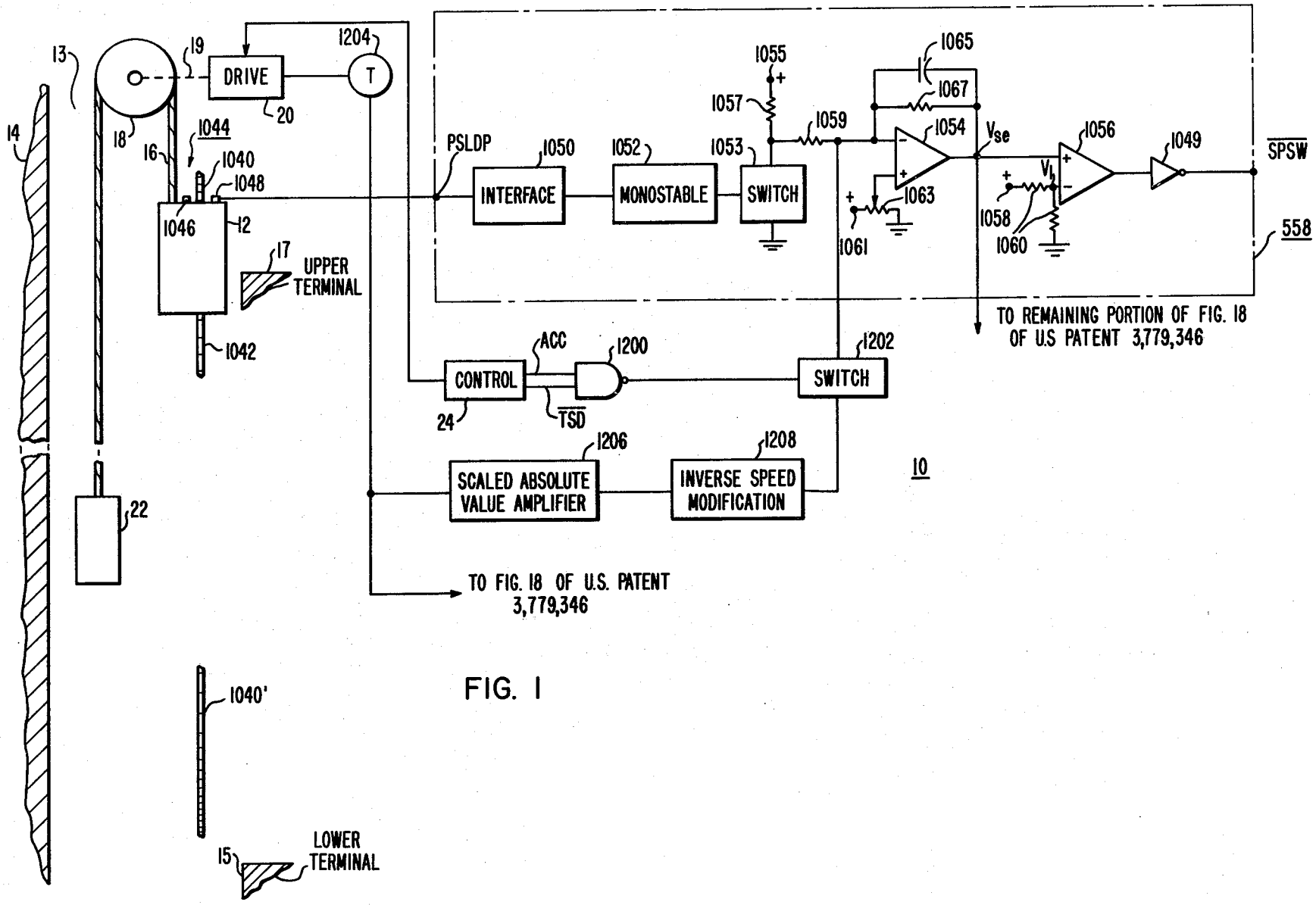
FIG. 1 is a partially schematic and partially block diagram of an elevator system constructed according to the teachings of the invention.

Referring now to the drawings, and to FIG. 1 in particular, there is shown a schematic diagram of a new and improved elevator system 10 constructed according to the teachings of the invention. Elevator system 10 includes an elevator car 12 mounted in a hoistway 13 for movement relative to a building or structure 14 having a plurality of floors or landings. Only the upper and lower terminal floors, indicated by reference numerals 15 and 17, respectively, are shown in order to simplify the drawing. The elevator car 12 is supported by a plurality of wire ropes 16 which are reeved over a traction sheave 18 mounted on the shaft 19 of a drive motor 20, such as a direct current motor as used in the Ward-Leonard drive system. A counterweight 22 is connected to the other ends of the ropes 16. The control for operating the drive motor 20, including the motor controller, speed pattern generator, distance slowdown control, and floor selector, are all shown generally in block function 24. The incorporated U.S. Pat. No. 3,779,346 may be referred to for details of such control.

The distance slowdown control portion of control 24 provides the normal speed pattern for decelerating and stopping the elevator car 12 at a terminal floor, and at the intermediate floors. The redundant and independent terminal slowdown control is provided by a combination of pick-up means and spaced marker means, which are arranged for relative movement as the elevator car approaches a terminal floor. For purposes of example, it will be assumed that the pick-up means is mounted on the elevator car, indicated generally at 1044, and that the spaced marker means is in the form of elongated plates or blades 1040 and 1040' disposed adjacent to the upper and lower terminal floors 17 and 15, respectively. The blade 1040 and 1040', in order to function as spaced markers, are provided with notches, holes or openings 1042. The blades define a "terminal zone" adjacent to each terminal floor.

The notches or openings 1042 are spaced and oriented such that the pick-up means 1044 on the elevator car 12 can detect their presence as the elevator car 12 approaches a terminal floor and initiate pulses which are utilized by a terminal slowdown control circuit 558.

The openings 1042 in the slowdown blades are spaced such that if the elevator car is slowing down with the desired constant rate of deceleration, the time elapsed as the elevator car travels from one opening to the next stays constant. If the elevator car is not decelerating, or the deceleration rate of the elevator car is not within acceptable limits, the time between the spaced openings will be shorter than normal and a monitoring circuit in the terminal slowdown control circuit 558 will detect this overspeed condition and cause the car to initiate terminal slowdown.

The same blade 1040 used to detect overspeed is used to generate the auxiliary speed pattern when an overspeed condition is detected, as described in the incorporated patent.

Pick-up means 1044 detects the presence of any notches or holes 1042. Pick-up means 1044 may be of any suitable type, such as optical or magnetic. For example, if it is of the optical type, a source 1046 of electromagnetic radiation is directed towards and spaced from a receiver 1048 of such radiation, with the discontinuities of the blade 1040 passing between the source and receiver when the car is traveling in the hoistway adjacent to a terminal floor. The receiver 1048 includes means for generating pulses as the discontinuities of the blade 1040 and the pick-up means 1044 move relative to one another, which pulses are applied to an input terminal PSLDP of the terminal slowdown circuit 558.

The present invention relates to a modification of the terminal slowdown function 558. The PSLDP pulses are applied to an interface circuit 1050, which may include any necessary apparatus for amplifying the signal, as well as apparatus for providing a voltage level change which may be required between the generated voltage level of the pulses, and the logic level required by the terminal slowdown function 558.

After the pulses leave interface 1050, they are applied to a monostable multivibrator 1052. The output of the monostable multivibrator 1052 is a series of constant width pulses spaced according to the rate at which pulses are received from the amplifier 1050. The pulses from the monostable are used to gate a switch 1053, which has one side connected to a positive source 1055 of unidirectional potential via resistor 1057, and its other side is connected to ground. A low pass filter amplifier 1054 is connected to the junction 1051 between the switch 1053 and resistor 1057. The filter amplifier 1054 may be an operational amplifier (op amp) having its inverting input connected to junction 1051 via resistor 1059. Its non-inverting input is connected to a source 1061 of positive unidirectional potential via an adjustable resistor 1063. Parallel connected capacitor 1065 and resistor 1067 are connected in the feedback loop of the op amp.

In the absence of a pulse from the monostable multivibrator 1052, switch 1053 is open, and the positive source 1055 is connected to the inverting input of filter amplifier 1054. When a pulse is received from the monostable multivibrator 1052, switch 1053 closes to connect the inverting input of filter amplifier 1054 to ground. When the slowdown of the elevator car is normal, the low pass filter amplifier provides a constant unidirectional output voltage which is adjusted to zero, as there is no speed error. If the speed of the car exceeds the predetermined speed profile, the pulse rate applied to switch 1053 increases, which increases the relative time the switch 1053 is connected to ground, making the effective input voltage less positive and the output voltage of the filter amplifier 1054 more positive. The output of amplifier 1054 is the speed error, referenced $V_{se}$.

The output of the low pass filter amplifier 1054 is applied to a comparator 1056, such as an op amp, with the output of the low pass filter amplifier 1054 being connected to the non-inverting input of the op amp 1056. A reference voltage $V_1$ comprising a source 1058 of unidirectional voltage and a voltage divider 1060, is applied to the inverting input of op amp 1056. The magnitude of the reference voltage $V_1$ is the magnitude which would be developed by the low pass filter when the elevator car is exceeding a selected maximum allowable speed as it approaches a terminal floor. Thus, when the output of the low pass filter 1054 is below the reference voltage, the output of op amp 1056 will be negative, or at the logic zero level. When the output of the low pass filter reaches the magnitude of the reference voltage, the output of op amp 1056 will switch to a positive polarity, or logic one level, which is inverted by inverter 1049 to provide a low or true signal at the output terminal $\overline{SPWS}$. A true $\overline{SPSW}$ signal indicates an overspeed condition of an elevator car approaching a terminal floor. The invention incorporates an anticipation factor into the signal $\overline{SPSW}$. The speed error $V_{se}$ at the output of filter amplifier 1054 is also used to develop additional protective signals, and the teachings of the invention will automatically incorporate the anticipation feature into these signals if the modification of the terminal slowdown circuit is applied to op amp 1054.

More specifically, the invention first recognizes when the terminal slowdown function 558 should be modified, and when it should be allowed to operate without modification. Once the necessity for modification is detected, the invention tailors the modification according to the speed of the elevator car. The magnitude of the modification is inversely proportional to the speed of the elevator car at the instant of modification. If the car is accelerating towards a terminal in a terminal zone, modification is necessary because of the time required to change between acceleration and deceleration in a jerk-limited manner. If a car is traveling in a terminal zone towards a terminal floor and has not yet been set to decelerate and stop at the terminal floor, modification is also necessary, regardless of whether or not the elevator car is accelerating. Both of these conditions may be detected from the signal ACC developed in the floor selector 34 of the incorporated patent. Signal ACC is true when a car is making a run, until the time the floor selector has recognized a target floor and has set itself to decelerate and stop at the floor. Thus, if the car is in a terminal zone, i.e., the blade 1042 has been encountered by the detector on the car, and PSLDP pulses are being generated, and the signal ACC is still set, i.e., at the logic one level, the modifications of the invention should be effected. To insure that the terminal slowdown circuit 558 has not already triggered terminal slowdown, in which case the modification should not be made as it would change the threshold for the next level of overspeed, the signal $\overline{TSD}$ is also used in the decision logic for detecting when the terminal slowdown function 558 should be modified. Signal $\overline{TSD}$ is developed in FIG. 21 of the incorporated patent.

Signals ACC and $\overline{TSD}$ are monitored by a NAND gate 1200. If signal ACC is not true, the logic zero will force a logic one at the output of NAND gate 1200. If signal $\overline{TSD}$ is true, the logic zero will force a logic one at the output of NAND gate 1200. Only when signal ACC is a logic one and signal $\overline{TSD}$ is a logic one will NAND gate 1200 output a zero, and this is the condition which should trigger the modification of the terminal slowdown circuit 558. The output of NAND gate 1200 may be used to control a switch 1202, such as a transistor, with the condition of the switch 1202 responding to the logic level of the NAND gate 1200. The condition of the switch 1202 determines whether or not the terminal slowdown circuit 558 is modified.

The magnitude of the modification is inversely proportional to the speed of the elevator car 12. The speed of the elevator car 12 may be determined by a tachometer 1204 driven by the sheave 18, or it may be responsive to the speed of the drive motor 20, or any other suitable device whose movement is proportional to car speed. Since only the magnitude of the car speed is important, the output of the tachometer is applied to a scaled absolute value amplifier 1206, such as an operational amplifier connected to provide a rectification of the tachometer signal and thus provide a unidirectional signal of the desired scale regardless of car direction. The desired inverse characteristic is developed by applying the output of the absolute value amplifier 1206 to a circuit 1208 tailored to develop the desired output.

The application of the output signal from circuit 1208 to the terminal slowdown function 558 is controlled by switch 1202. The application of the modifying signal may be made at any suitable point in the terminal slowdown circuit 558. For example, if it is desired to only modify the signal $\overline{SPSW}$, and not the next higher level speed indication signal, one of the inputs to comparator 1056 may be modified. If it is desired to modify the speed error signal $V_{se}$ and thus all signals developed therefrom, the modification may be applied to op amp 1054. For purposes of example, as illustrated in FIG. 1, the modification is applied to the inverting input of op amp 1054. Since in the arrangement of the terminal slowdown circuit 558 the modification must increase the magnitude of the speed error signal $V_{se}$, the output of the inverse speed modification circuit 1208 must be such that it draws current away from the inverting input of op amp 1054. Further, more current must be drawn away from the inverting input when the car is running slow than when it is running at a faster speed. This means that the terminal slowdown tripping frequency is reduced by a greater amount when the elevator car is running slower and is reduced by smaller amounts as the car runs faster. If the car speed exceeds a pre-selected value, no modification is applied.

Figure 2:
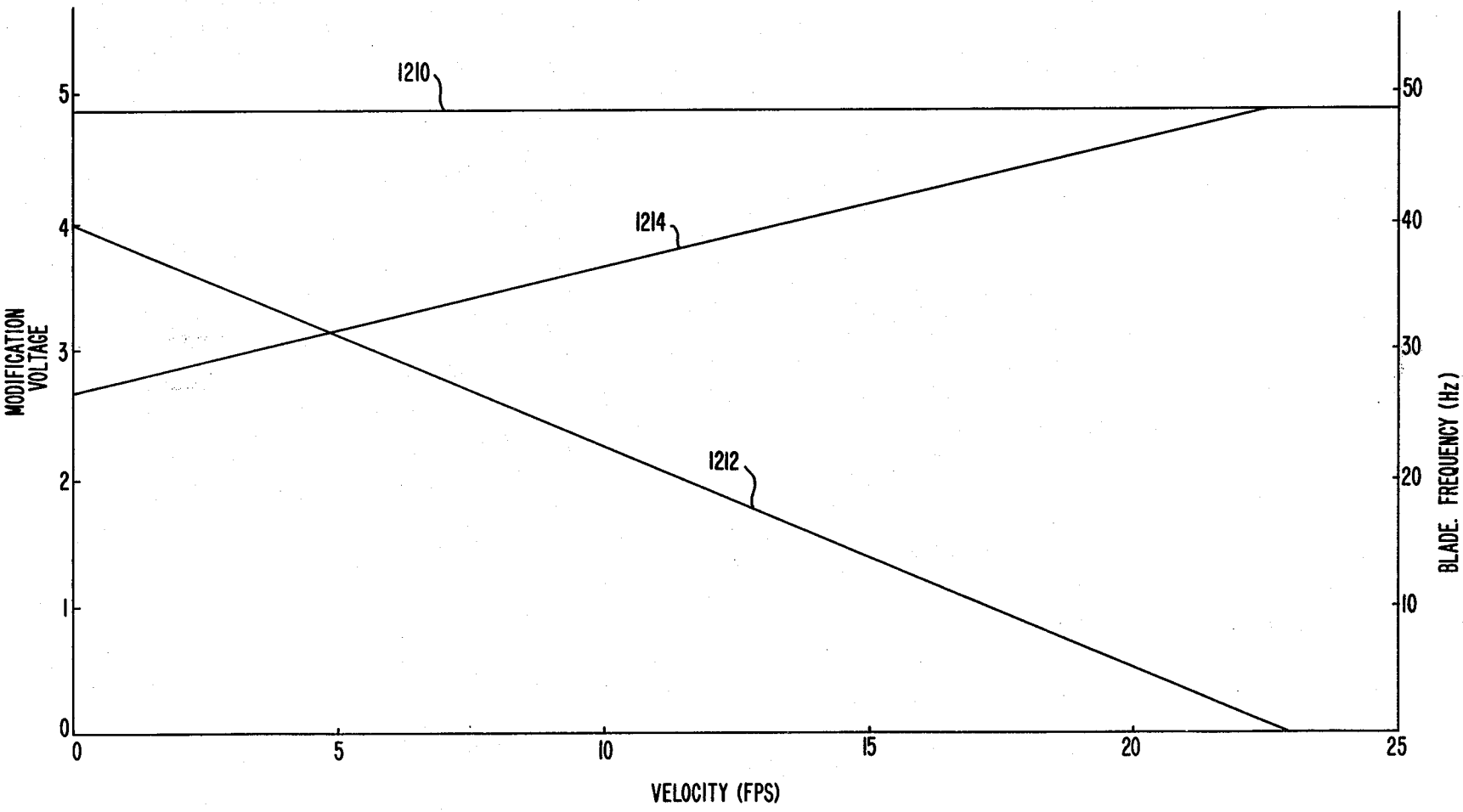
FIG. 2 is a graph which will aid in the understanding of the invention.

FIG. 2 is a graph which will aid in the understanding of the invention. The modification voltage, and the frequency which will trigger the terminal slowdown circuit to provide a true $\overline{SPSW}$ are both plotted against car velocity. Curve 1210 illustrates the normal trip frequency of the blade 1042, such as 48 Hz. If the pulse frequency developed from the blade 1042 exceeds 48 Hz., the signal $\overline{SPSW}$ is set to the logic zero level. It will be noted that the normal trip frequency is constant and does not change with car speed.

Curve 1212 illustrates the modification voltage developed by the inverse speed modification function 1208. It will be noted that the slower the speed of the elevator car, the greater the magnitude of the modification voltage, and vice versa. It will also be noted that when the car speed is above 23 FPS in this example, the modification voltage is zero. In the specific embodiment of FIG. 1, the modification voltage will be negative since it must draw current away from the inverting input of op amp 1054.

Curve 1214 illustrates the trip frequency curve when the modification of the terminal slowdown circuit 558 according to the invention is in effect. The slower the car, the lower the blade frequency which will initiate a true $\overline{SPSW}$ signal. This is the desired result, as the slower the car, the greater the percentage of time the transition between acceleration and deceleration becomes. Thus, signal $\overline{SPSW}$ should be tripped accordingly, with the advancement in time being continuously adjusted according to the speed of the elevator car at every instant.

Figure 3:
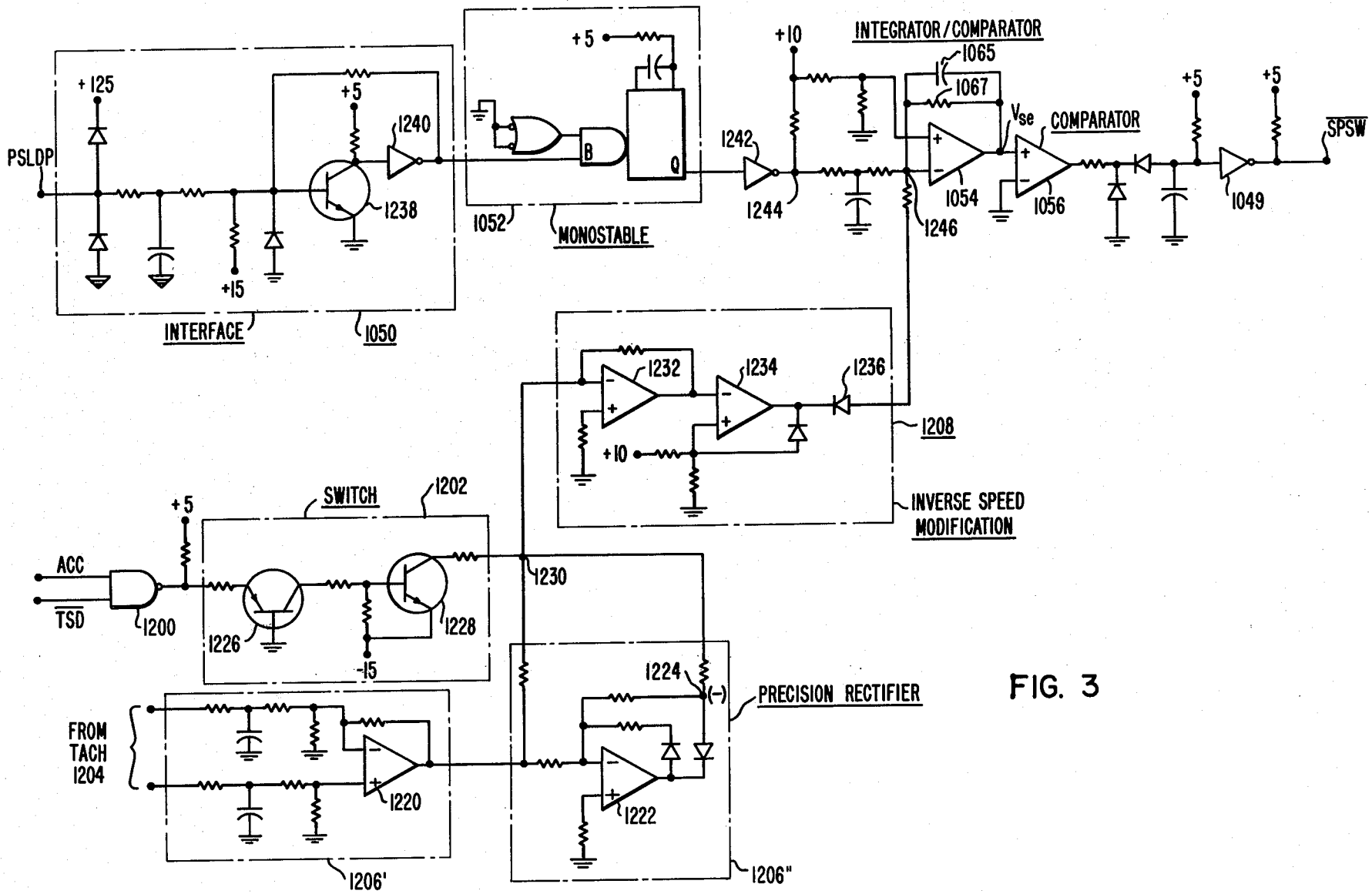
FIG. 3 is a schematic diagram which illustrates a specific embodiment of the invention.

FIG. 3 is a detailed schematic diagram of a terminal slowdown circuit constructed according to the teachings of the invention. The scaling and absolute value portions of function 1206 shown in FIG. 1 are broken into two functions, 1206' and 1206" in FIG. 3. Function 1206' filters the tachometer signal and removes common noise by applying both leads from tachometer 1204 to the two inputs of an op amp 1220. The differentially amplified tachometer signal is applied to function 1206" which includes an op amp 1222 connected as a precision rectifier. The negative polarity output of the precision rectifier amplifier 1206", which appear at terminal 1224, is effectively controlled by switch 1202, as the output terminal 1224 of the precision rectifier amplifier 1206" is connected to the output of switch 1202 at junction 1230, and junction 1230 is connected to the inverse speed modification circuit 1208. Switch 1202 includes a PNP transistor 1226 and a NPN transistor 1228. As long as one of the signals ACC or $\overline{TSD}$ is low, the output of NAND gate 1200 is high. The switch 1202 has both transistors conducting to apply a relatively large negative voltage to junctin 1230. The value of this relatively large negative voltage is selected such that the voltage appearing at junction 1230 indicates a car speed in excess of the speed which requires modification, regardless of the actual car speed. The resulting negative voltage is applied to the inverse speed modification function 1208. When a large negative voltage, i.e., one corresponding to a space greater than 30 FPS, for example, is applied to the inverse speed modification circuit 1208, the terminal slowdown function is allowed to operate without modification. Thus, if the actual car speed is above 30 FPM, or if switch 1202 is conductive, the negative voltage at junction 1230 will be large enough to prevent modification of the terminal slowdown function.

When signals ACC and $\overline{TSD}$ are both high, the low output from NAND gate 1200 turns off the transistors to remove the large negative voltage from junction 1230, and the negative voltage output from the precision rectifier amplifier 1206" is then effective in controlling the inverse speed modification circuit 1208. The terminal slowdown function is thus modified, if the actual car speed is below 30 FPS, with the magnitude of the modification being inversely proportional to the speed of the elevator car.

The inverse speed modification circuit 1208 includes op amps 1232 and 1234. When the input to op amp 1232 is negative, its output is positive and the output of operational amplifier 1234 is positive. Diode 1236 draws current away from op amp 1054 when the output voltage from op amp 1234 indicates a car speed less than 30 FPM. When the output voltage of op amp 1234 corresponds to a speed greater than 30 FPM, diode 1236 becomes reverse biased, and the inverse speed modification function 1208 has no effect on the integrator/comparator function.

Thus, when the transistors of switch 1202 are rendered nonconductive, the negative output of the precision rectifier amplifier 1206" appears at the inverting input of op amp 1232, and its output goes positive by an amount corresponding to the actual speed of the car. The output of op amp 1234 also goes positive. If the output of op amp 1234 is less positive than the reference applied to the non-inverting input of op amp 1054, current will be drawn away from the inverting input of op amp 1054, making the output increase in the positive direction. The slower the speed of the elevator car, the less negative the input to op amp 1232, and the output becomes less positive. The input to the non-inverting input of op amp 1234 thus becomes less positive, and the output of op amp 1234 becomes less positive, drawing more current away from op amp 1054. This is the desired result.

Interface 1050 includes a transistor 1238 and an inverter 1240, along with waveform shaping and filtering components, which circuit provides a positive pulse at logic voltage level at the output of inverter 1240 in response to a pulse at power level appearing at input terminal PSLDP. The pulses at input terminal PSLDP are the terminal slowdown blade responsive pulses, as hereinbefore described.

The pulses from interface 1050 are applied to a monostable multivibrator 1052, such as Texas Instrument's SN 74121. The output of the monostable is inverted via an inverter 1242 and applied to the integrator/comparator which includes operational amplifier 1054. The resistive network and +10 volt supply voltage are arranged to normally make the inverting input of op amp 1054 higher than the non-inverting input. Thus, the output of op amp 1054 is negative. The output of comparator 1056 is negative or at the logic zero level, and inverter 1049 inverts the output of comparator 1056 to a logic one level, to provide a high $\overline{SPSW}$ signal.

The higher the blade frequency, i.e., the higher the frequency of the pulses PSLDP, the lower or less positive the average voltage applied to junction 1244. When a predetermined frequency is reached, such as 48 Hz., as shown in FIG. 2, the voltage applied to the inverting input drops below the voltage applied to the non-inverting input, and the output of op amp 1054 switches positive. The output of comparator 1056 goes positive and the inverter 1049 applies a logic zero signal to output terminal $\overline{SPSW}$. The true signal $\overline{SPSW}$ initiates terminal slowdown.

When signals ACC and $\overline{TSD}$ are both high, and the speed of the elevator car is below a predetermined speed, the inverse speed modification function 1208 draws current away from junction 1246, causing the output of op amp 1054 to switch positive at a lower PSLDP pulse frequency. The slower the speed of the elevator car, the higher the current magnitude drawn away from junction 1246, causing the output of op amp 1054 to switch positive at a still lower pulse frequency, to provide a true $\overline{SPSW}$ signal sooner than for a faster traveling car. Thus, an accelerating car will have the necessary time to smoothly change between the desired positive and negative acceleration rates, without exceeding the desired jerk limitation.

I claim as my invention:

1. An elevator system, comprising:

a building having a hoistway and terminal floors, an elevator car mounted for guided movement in said hoistway, velocity means providing a velocity signal responsive to the speed of said elevator car, detector means providing a speed versus position signal as said elevator car approaches a terminal floor, overspeed means responsive to said speed versus position signal for providing an overspeed signal when a predetermined overspeed condition is detected, control means providing a control signal having a first condition when said elevator car is set to decelerate and stop at a terminal floor, and a second condition when it is not so set, and modification means operative when said control means is in its second condition and said detector means is providing the speed versus position signal, to change a parameter upon which the issuance of the overspeed signal by said overspeed means is based, with said change causing the issuance of the overspeed signal to be advanced in time, compared with the time at which it would otherwise be provided, with the magnitude of the advancement being inversely proportional to the magnitude of said velocity signal.

2. The elevator system of claim 1 wherein the overspeed means includes first comparator means for providing a speed error signal in response to the speed versus position signal, with the modification means advancing in time the issuance of the overspeed signal by changing the magnitude of said speed error signal, with the magnitude of the change being inversely proportional to the magnitude of the velocity signal.

3. The elevator system of claim 2 wherein the overspeed means includes second comparator means for providing the overspeed signal in response to the speed error signal.

4. The elevator system of claim 1 wherein the velocity means includes absolute value means such that the polarity of the velocity signal is the same for both the up and down travel directions of the elevator car.

5. The elevator system of claim 1 wherein the speed versus position signal is in the form of pulses, with each pulse being provided at a predetermined location of the car relative to a terminal floor, said pulses being generated at a predetermined constant frequency when the elevator car is decelerating normally to stop at a terminal floor, with the overspeed means providing the overspeed signal if the pulse frequency exceeds a predetermined trip frequency, and wherein the modification means effectively reduces the magnitude of the predetermined trip frequency, with the magnitude of the reduction being inversely proportional to the magnitude of the velocity signal.

* * * * *